US006413118B2

(12) United States Patent
Fukatsu

(10) Patent No.: US 6,413,118 B2
(45) Date of Patent: Jul. 2, 2002

(54) CONNECTOR HOUSING AND A CONNECTOR

(75) Inventor: Yukihiro Fukatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/853,532

(22) Filed: May 11, 2001

(30) Foreign Application Priority Data

May 18, 2000 (JP) ..... 2000-145934

(51) Int. Cl.[7] ..... H01R 13/73
(52) U.S. Cl. ..... 439/542; 439/717
(58) Field of Search ..... 439/701, 540.1, 439/542, 567, 717

(56) References Cited

U.S. PATENT DOCUMENTS 3,577,116 A * 5/1971 Baumanis ..... 439/542
5,295,870 A * 3/1994 Rei et al. ..... 439/717
5,545,060 A * 8/1996 Gow ..... 439/717
5,915,978 A * 6/1999 Hayakawa et al. ..... 439/717
5,967,857 A * 10/1999 Okabe ..... 439/542
6,179,653 B1 * 1/2001 Cheng et al. ..... 439/717

FOREIGN PATENT DOCUMENTS

EP 0 731 530 A2 9/1996
JP 8-222319 8/1996

* cited by examiner

*Primary Examiner*—Gary F. Paumen
(74) *Attorney, Agent, or Firm*—Anthony J. Casella; Gerald E. Hespos

(57) ABSTRACT

At least two connector housings (10) are mounted on a mounting member by one stay (S). The connector housings (10) are connected by engaging a first coupling portion (18) of one connector housing (10) with a second coupling portion (28) of the other connector housing (10). First and second locking portions (16, 26) of the respective connector housings (10) engage and resist separation of the connector housings (10). The connector housings (10) are disengaged by elastically deforming an elastic locking piece (22) to disengage the locking portions (16, 26) and to disengage the coupling portions (18, 28). One of the connected connector housing (10) is mounted on a stay (S) by inserting the stay (S) into an insertion space (23) and locking the stay (S) with a stay locking portion (24).

12 Claims, 8 Drawing Sheets

CONNECTOR HOUSING AND A CONNECTOR

BACKGROUND OF THE INVENTION

1. Field of the Invention

The present invention relates to a connector housing and to a connector with a plurality of such connector housings.

2. Description of the Related Art

A wiring harness in an engine compartment of an automotive vehicle can be arranged in a specified path by fixing the connector housings of the wiring harness to the vehicle body. FIG. 11 shows one conventional means for fixing a connector housing to a vehicle body 1. The fixing means of FIG. 11 comprises a plate-shaped stay 2 that is secured to the body 1, and that has a mount hole 3 at a location spaced from the body 1. A connector housing 4 has a bottom surface formed with a projection 5 and parallel guides 6 formed at opposite sides of the projection 5. The guides 6 each have a hook-shaped cross section and are configured for sliding receipt of the stay 2 between the guides 6. Sufficient movement of the stay 2 between the guides 6 will cause the projection 5 of the housing 4 to engage the mount hole in the stay 2.

A separate stay 2 is required to mount each connector housing 4 on the body 1. Many stays 2 may be required in an engine compartment, and the body 1 is required to have a space for arranging the many stays 2.

In view of the above, an object of the invention is to enable a plurality of connector housings to be mounted on a mating mounting member by one stay.

SUMMARY OF THE INVENTION

The invention is directed to a connector housing that has at least one terminal fitting mounted therein. The connector housing is connectable with a second connector housing, and is mountable on a mounting member via a stay. The connector housing is formed with at least one first coupling portion and at least one second coupling portion for connecting the connector housing with the second connector housing by engagement with a corresponding first coupling portion of the second connector housing. The connector housing also has at least one first locking portion. At least one elastic locking piece has a portion that is spaced from an outer surface of the connector housing. Thus, an insertion space for the stay is defined between the locking piece and the outer surface of the connector housing. The locking piece is elastically deformable to incline toward and away from the connector housing. The connector housing further includes a stay locking portion for engaging the stay and preventing the stay from being withdrawn from the insertion space. The stay locking portion is formed on the surface of the elastic locking piece that faces the insertion space. A second locking portion is formed on a surface of the elastic locking piece substantially opposite from the insertion space. The second locking portion engages the first locking portion of the second connector housing and prevents the connector housings from disengaging from each other.

The invention also is directed to an assembly of first and second connector housings that can be connected with one another. Terminal fittings are accommodated in the connector housings, and can be connected with terminal fittings in mating connector housings. The connector housings are mountable on a mounting member via a stay. Outer surfaces of each connector housing may be formed with a first and second coupling portions. The first coupling portion of one connector housing can be engaged with the second coupling portion of the other connector housing for connecting the connector housings with each other. The assembly further comprises a first locking portion. An elastic locking piece extends along and is spaced from an outer surface of each connector housing, such that an insertion space for the stay is defined between the elastic locking piece and the outer surface. Each locking piece is elastically deformable to incline toward and away from the outer surface of the connector housing. A stay locking portion is provided on an inner surface of the elastic locking piece and faces the insertion space. The stay locking portion engages the stay to prevent the stay from being withdrawn from the insertion space. A second locking portion is formed on an outer surface of the elastic locking piece opposite from the insertion space. The second locking portion of one connector housing can engage the first locking portion of the other connector housing to prevent disengagement of the connector housings.

The inserting direction of the stay into the insertion space preferably is substantially the same as an extending direction of the elastic locking piece.

With the stay inserted in the insertion space, the base end of the stay extends out of the insertion space toward the side opposite the extending end of the elastic locking piece. Accordingly, a finger or a jig can be placed on the extending end of the elastic locking piece without any interference with the stay to disengage the stay from stay locking portion of the elastic locking piece.

A jig may be inserted between the connected connector housings to incline the elastic locking piece in a direction that moves the second locking portion away from the first locking portion. More particularly, the jig may be inserted into a jig insertion opening formed in a side opposite from a wire draw-out surface of the connector. Thus, the wires do not interfere with the insertion of the jig. An inserting direction of the jig into the connector housing preferably is substantially the same as an extending direction of the elastic locking piece.

The jig is inclined to incline the elastic locking piece. The point of inclination of the jig and the point of inclination of the elastic locking piece preferably are substantially at the same position at this time. Thus, the jig can be held substantially along the elastic locking piece.

An escape recess is formed in the outer surface of the connector housing at a location substantially adjacent the first locking portion. The escape recess accommodates an inclining movement of the jig, and hence enables the jig to incline the elastic locking piece. The disposition of the escape recess enables a narrowing of a clearance between the outer surface where the first locking portion is formed and the outer surface where the elastic locking piece is formed. The escape recess preferably is inclined with respect to an insertion direction of the jig into the insertion opening of the connector housing.

The first coupling portion preferably comprises at least one first stopper that can substantially abut a corresponding second coupling portion of the other connector housing. Similarly, the second coupling portion may comprise at least one second stopper that can substantially abut a corresponding first coupling portion of the other connector housing. Thus, the first and second stoppers preferably abut the corresponding second and first coupling portion substantially simultaneously. Accordingly, loose movement of the connector housings in the mating direction, is restricted.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
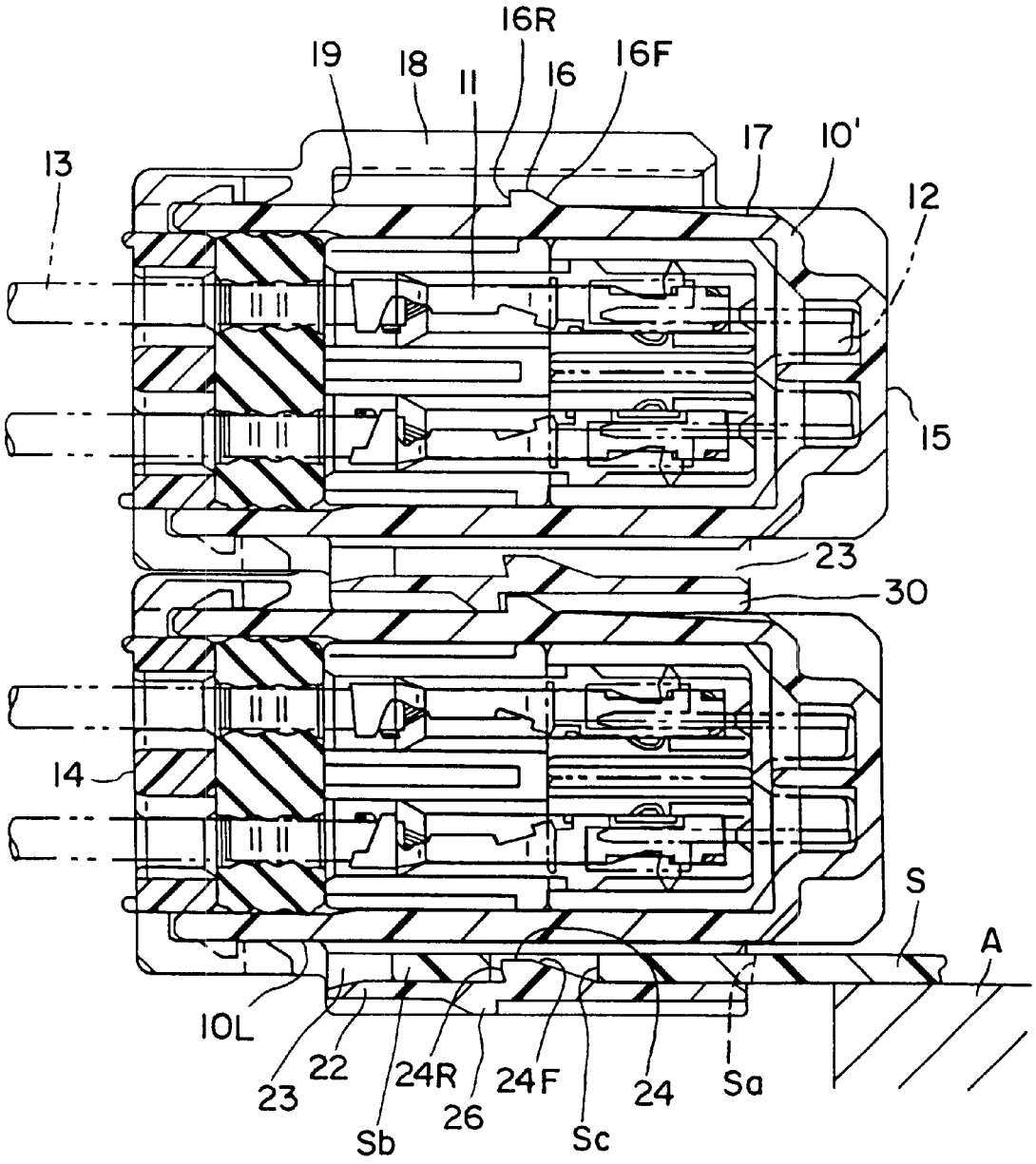
FIG. 1 is a section showing a state where connector housings of a connector according to one preferred embodiment of the invention are connected and the connector is mounted on a stay.
Figure 2:
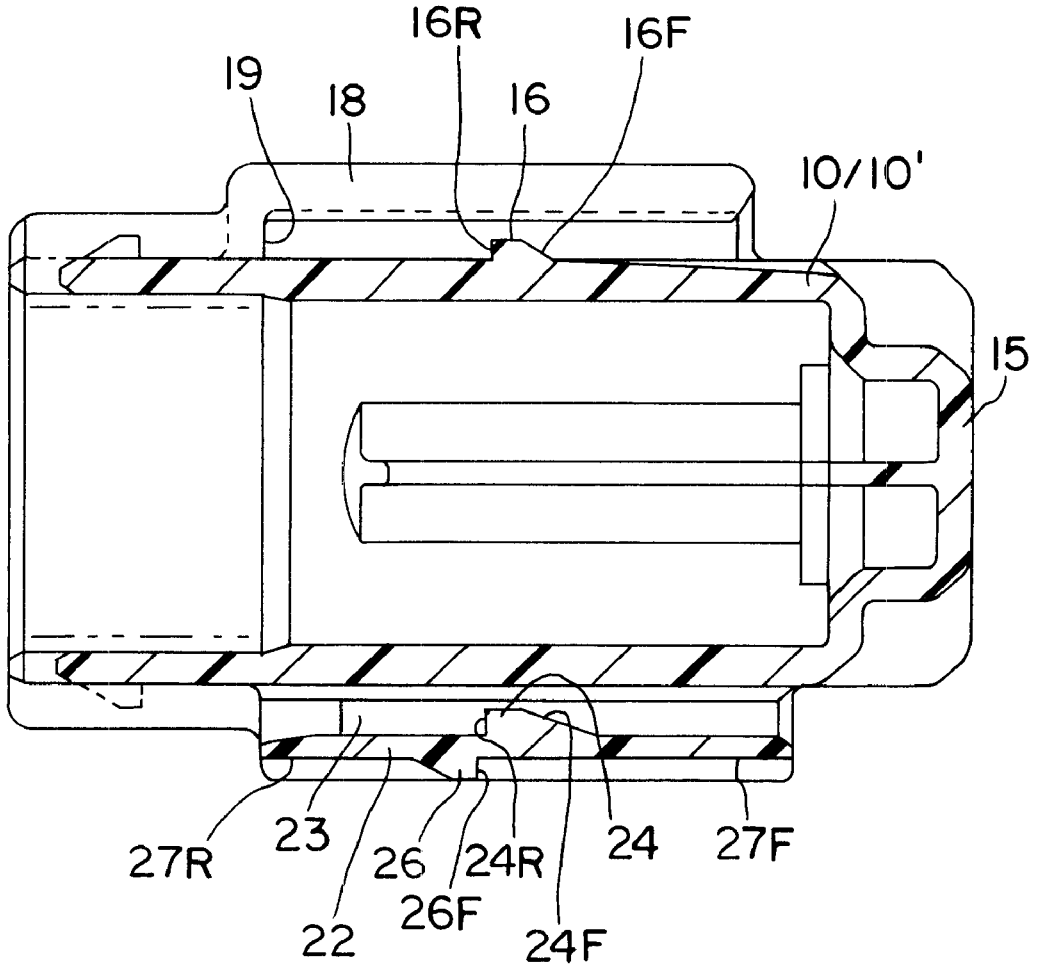
FIG. 2 is a section of the connector housing according to one preferred embodiment of the invention.
Figure 5:
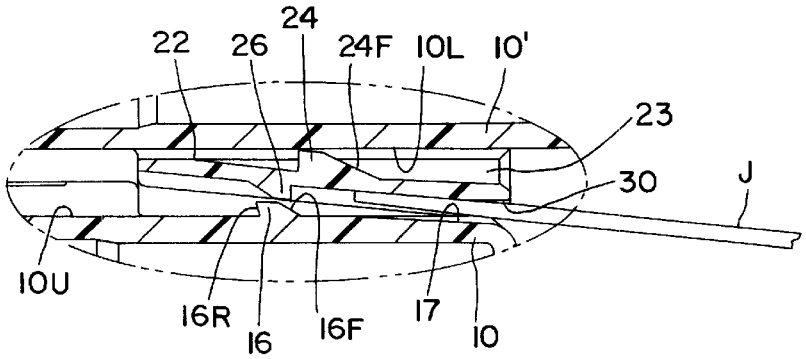
FIG. 5 is a partial section showing a state where the connector housings are unlocked.
Figure 6:
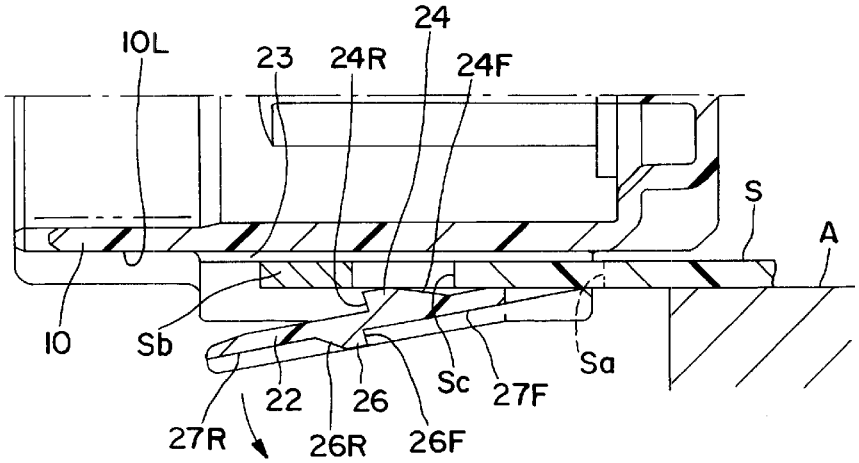
FIG. 6 is a partial section showing a state where an elastic locking piece and a stay are unlocked.

A connector housing according to the invention is identified by the numeral 10 in FIGS. 1–10, and is mountable on a mounting member A via a stay S. The stay S is substantially plate-shaped and is secured horizontally to the mounting member A such that a leading end of the stay S is cantilevered beyond an upper surface of the mounting member A, as shown in FIGS. 1 and 6. The stay S is substantially rectangular in plan view. However, opposite side edges of the stay S are stepped adjacent the leading end, as shown by phantom line in FIG. 8. Thus, the leading end of the stay S that is engaged with a connector housing 10 is narrower than the base end. The stepped side edges define contact portions Sa on sections of the base end adjacent the narrow portion Sb. The narrow portion Sb of the stay S is formed with a substantially rectangular locking hole Sc in a widthwise center position.

In the description below, the right side in FIGS. 1 to 8 is referred to as the front and the vertical direction is based on the orientation of FIGS. 1 to 6.

A connector in accordance with the invention is a joint connector and is comprised of a connector housing 10, a plurality of harness-side terminal fittings 11 inserted into the connector housing 10 from behind, and a joint terminal fitting 12 that electrically connects the harness-side terminal fittings 11 inside the connector housing 10. Wires 13 are connected with the harness-side terminal fittings 11 and are drawn out backwardly through a wire draw-out surface 14 at the rear end of the connector housing 10.

The connector housing 10 preferably is in the form of a substantially rectangular parallelepiped with a width larger than its height, and a front end that is closed by a front wall 15. The connector housing 10 has a substantially flat upper surface 10U, and a first locking projection 16 is formed substantially in a middle position of the upper surface 10U both with respect to widthwise direction and forward and backward directions. The first locking projection 16 has a front guide surface 16F that is inclined in forward and backward direction with respect to the upper surface 10U of the connector housing 10. The rear surface of the first locking projection 16 is a locking surface 16R that extends up from the upper surface 10U of the connector housing 10 substantially at a right angle or in an overhanging manner.

Figure 7:
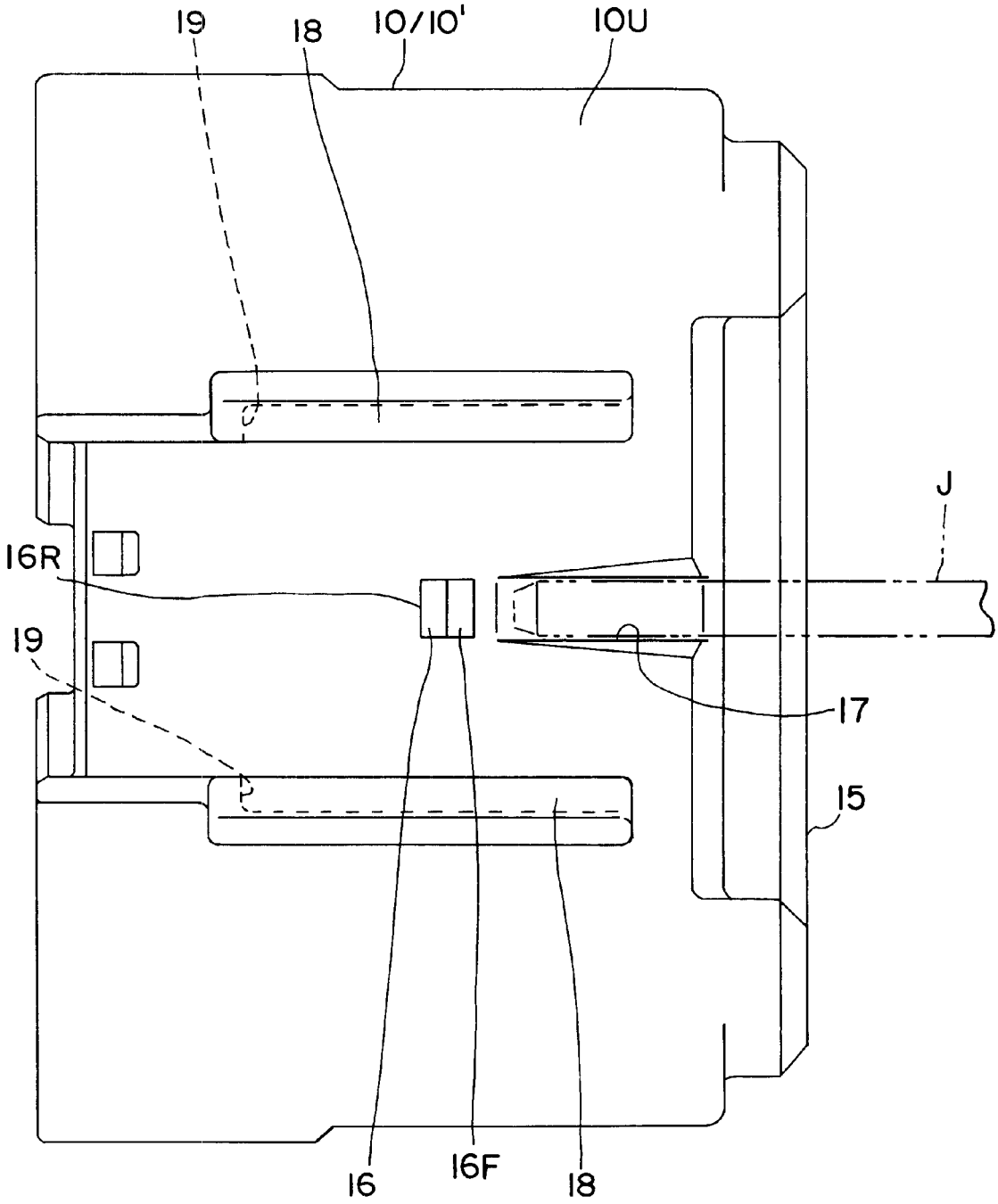
FIG. 7 is a plan view of the connector housing.
Figure 8:
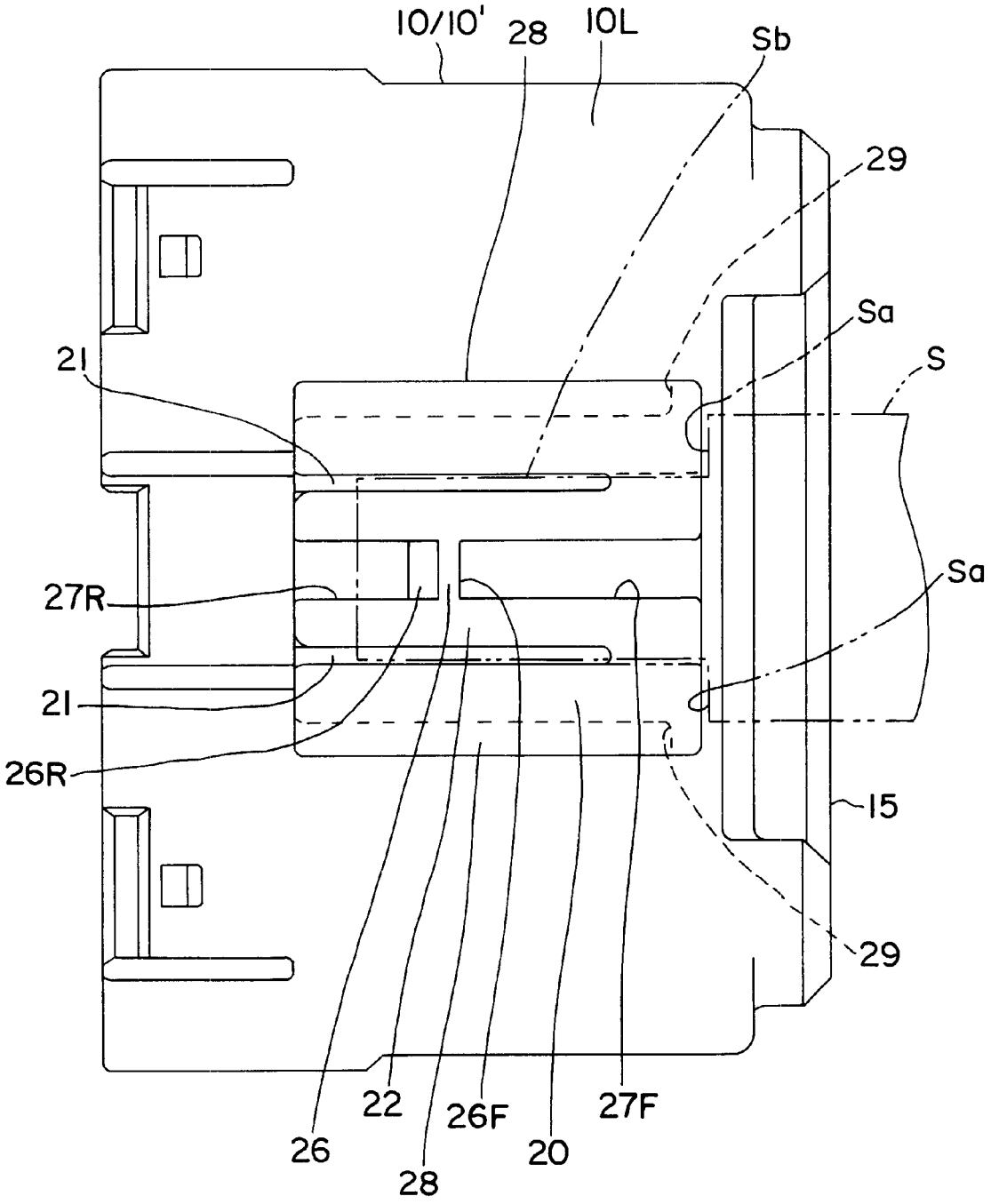
FIG. 8 is a bottom view of the connector housing.

An escape recess 17 is formed in the upper surface 10U in a position before the first locking projection 16. The escape recess 17 is narrow in forward and backward directions and inclined downward to the front. Thus, the escape recess 17 is deeper toward its front end. Left and right inner surfaces of the escape recess 17 are inclined to be wider toward the upper end when viewed from front. Therefore, the escape recess 17 is wider at its upper end toward the front of the connector housing 10 while being of substantially equal width at its bottom end (FIG. 7). Accordingly, the escape recess 17 has substantially V-shape or trapezoidal shape in cross-section. The bottom surface of the escape recess 17 has a substantially constant width over its entire length substantially equal to the width of the first locking projection 16.

Figure 9:
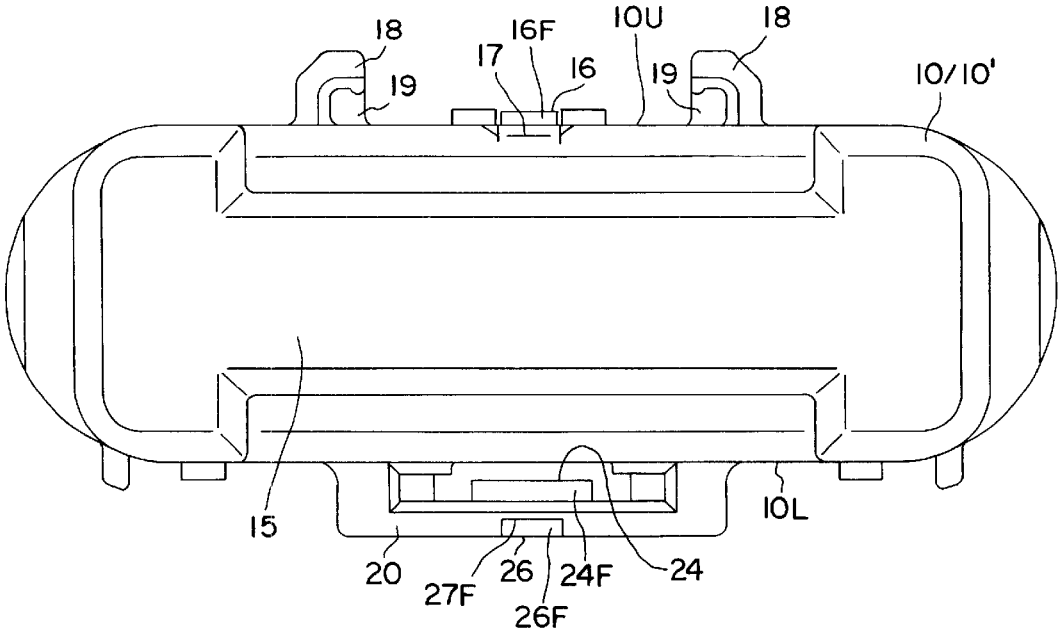
FIG. 9 is a front view of the connector housing.
Figure 10:
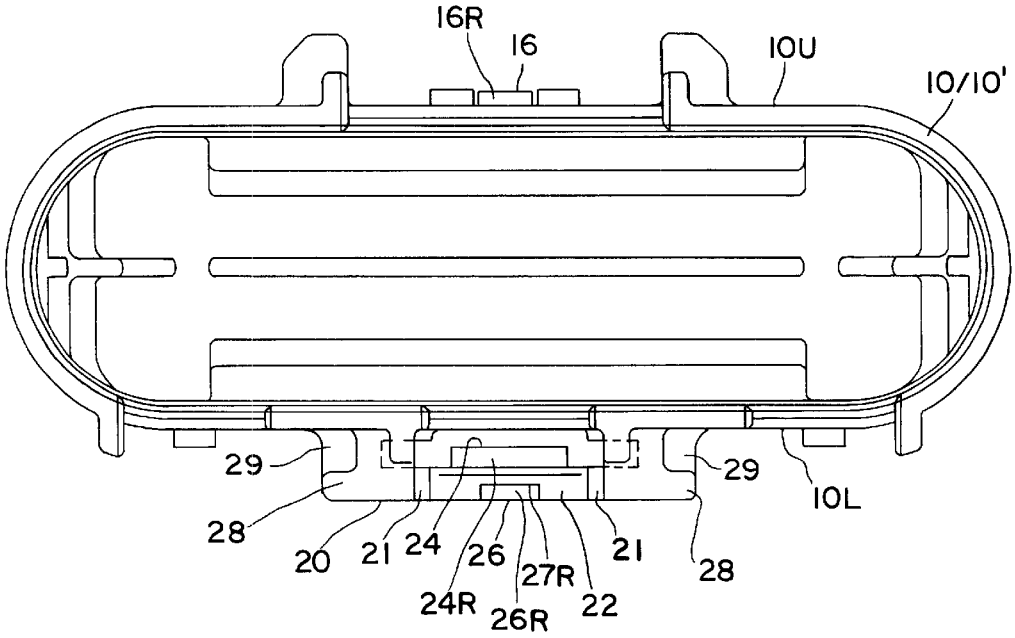
FIG. 10 is a rear view of the connector housing.
Figure 11:
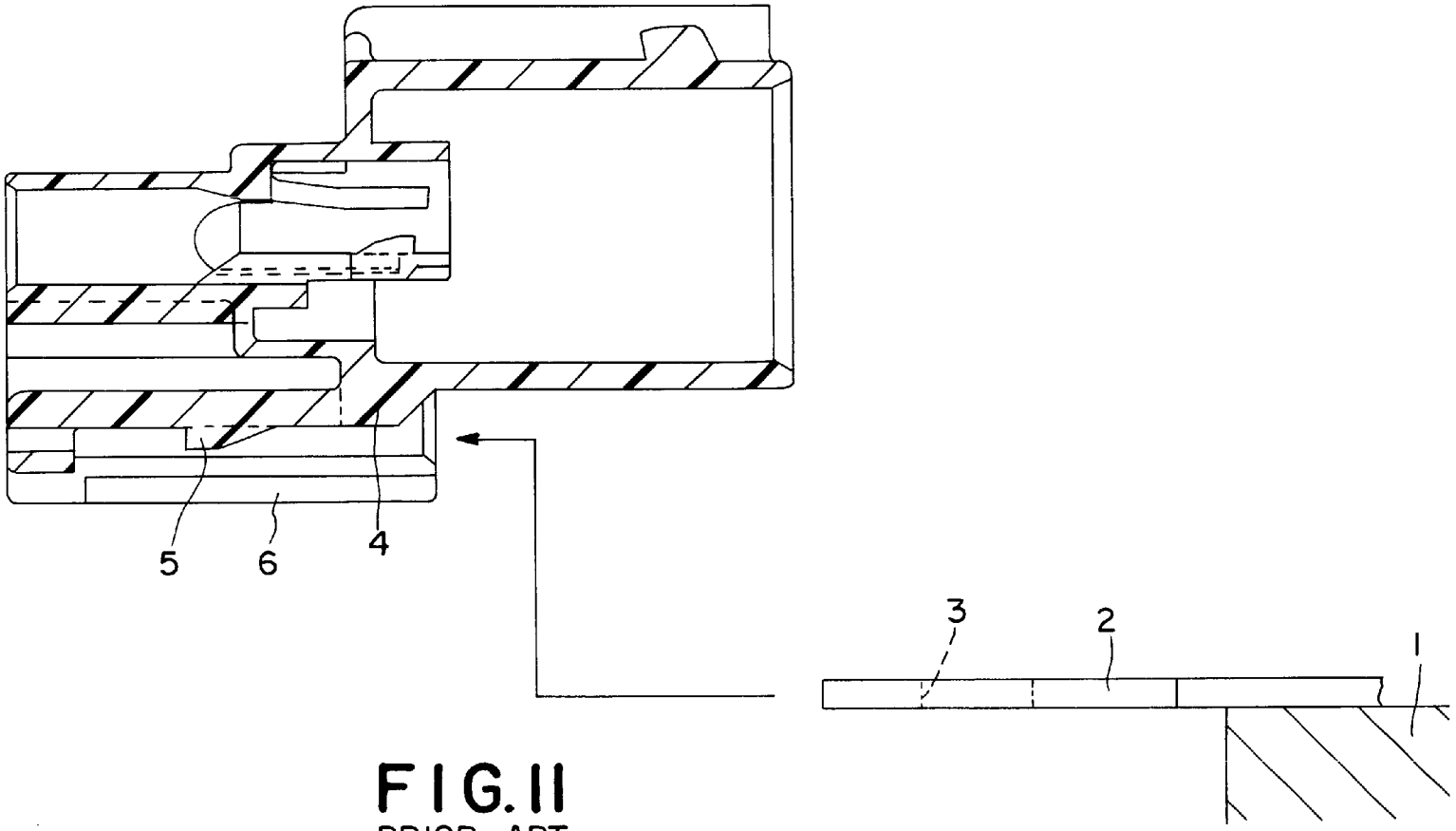
FIG. 11 PRIOR ART
FIG. 11 is a section of a prior art means for mounting a connector on a stay.

Left and right first coupling ribs 18 extend in forward and backward directions at opposite sides of the first locking projection 16 on the upper surface 10U of the connector housing 10. Each coupling rib 18 has a substantially L-shaped cross section, with a horizontal section that extends inwardly, as shown in FIG. 9. A first stopper 19 is formed at the rear of the first coupling rib 18.

The connector housing 10 has a substantially flat lower surface 10L, and a substantially rectangular plate 20 is formed substantially in a widthwise center of the lower surface 10L. Opposite side edges of the plate 20 are continuous with the lower surface 10L of the connector housing 10, and central portions of the plate 20 are substantially parallel to and spaced from the lower surface 10L. Left and right slits 21 are formed symmetrically on opposite sides of the center of the plate 20, and form an elastic locking piece 22 that cantilevers backward.

This elastic locking piece 22 is substantially parallel to and spaced from the lower surface 10L of the connector housing 10 to define an insertion space 23 for the stay S. Additionally, the elastic locking piece 22 is elastically deflectable in a substantially vertical direction toward and away from the lower surface 10L of the connector housing 10.

A stay locking projection 24 is formed on the surface of the elastic locking piece 22 that faces into the insertion space 23, and locks to the stay S for preventing the stay S from being withdrawn from the insertion space 23. The front of the stay locking projection 24 defines a guide surface 24F that is inclined with respect to forward and backward directions, and the rear of the stay locking projection 24 defines a locking surface 24R that overhangs or extends substantially at a right angle to the upper surface 10U of the connector housing 10.

A second locking projection 26 is formed on the outer surface of the elastic locking piece 22, which is the side opposite from the insertion space 23, and can be engaged with the first locking projection 16 of a second connector housing 10' as shown in FIG. 1. The front of the second locking projection 26 defines a locking surface 26F that overhangs or extends at a right angle to forward and backward directions, and the rear surface of the second locking projection 26 defines a guide surface 26R that is inclined with respect to forward and backward directions. Guide grooves 27F, 27R are formed in the lower surface of the elastic locking piece 22 and extend forward and backward from the second locking projection 26.

Second coupling ribs 28 project outwardly at opposite side edges of the plate 20 and extend linearly and parallel in forward and backward directions. The second coupling ribs 28 can be slid in forward and backward directions into engagement with the grooves of the first coupling ribs 18 of the mating connector housing 10. Second stoppers 29 are formed at the front ends of the second coupling portions 28.

The extension of the elastic locking piece 22 is substantially the same as a direction in which the connector housing 10 formed with the elastic locking piece 22 is fitted to the mating connector housing 10' of FIG. 1. The extension of the elastic locking piece 22 also is substantially the same as a direction in which the stay S is inserted into the insertion space 23. Additionally, the extension of the elastic locking piece 22 is substantially the same as a direction in which a jig J is inserted into the connector housing 10. The inserting direction of the stay S into the insertion space 23 is substantially the same as the inserting direction of the jig J into the connector housing 10. Additionally, the direction in which the wires 13 are drawn out from the connector housing 10 is substantially the same as the extension of the elastic locking piece 22. The drawing direction of the wires 13 from the connector housing 10 is substantially the same as the inserting direction of the stay S into the insertion space 23. Finally, the drawing direction of the wires 13 from the connector housing 10 is substantially the same as the inserting direction of the jig J into the connector housing 10.

The upper and lower connector housings 10', 10 of FIG. 1 are connected with each other by engaging the second coupling ribs 28 of the upper connector housing 10' with the first coupling ribs 18 of the lower connector housing 10 from the front in FIG. 1. During this connecting operation, the first locking portions 16 of the lower connector housing 10 move in the front guide groove 27F of the upper connector housing 10'. Subsequently, when the guide surfaces 16F, 26R of the first and second locking projections 16, 26 contact each other, the elastic locking piece 22 of the upper connector housing 10' is displaced elastically upward (direction closer to the. lower surface 10L of the upper connector housing 10') by the inclination of the guide surfaces 16F, 26R. The second locking portion 26 of the elastic locking piece 22 then.moves over the first locking projection 16 of the lower connector housing 10.

When the connector housings 10, 10' are connected properly, the elastic locking piece 22 is restored elastically substantially to its original position to engage the locking surface 26F of the second locking portion 26 with the locking surface 16R of the first locking projection 16. This prevents the upper connector housing 10' from being disengaged in a forward direction from the lower connector housing 10. Simultaneously, the rear ends of the second coupling portions 28 of the upper connector housing 10' abut against the first stoppers 19 of the first coupling portions 18 of the lower connector housing 10, and the second stoppers 29 of the second coupling portions 28 abut against the front ends of the first coupling portions 18. These two abutments restrict any further loose movement of the connector housings 10, 10' in the fitting direction. In this way, the connector housings 10, 10' are locked into each other while having their relative movements in forward and backward directions restricted.

Figure 3:
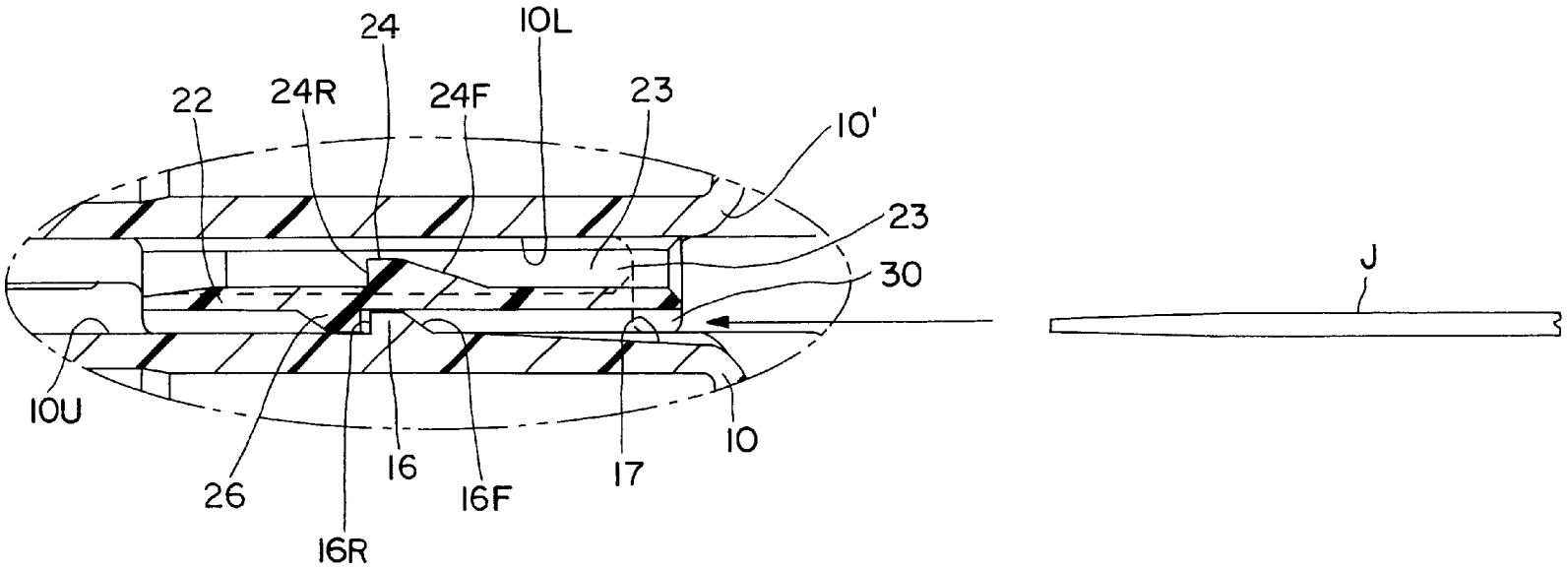
FIG. 3 is a partial section showing a state before the connector housings are unlocked.
Figure 4:
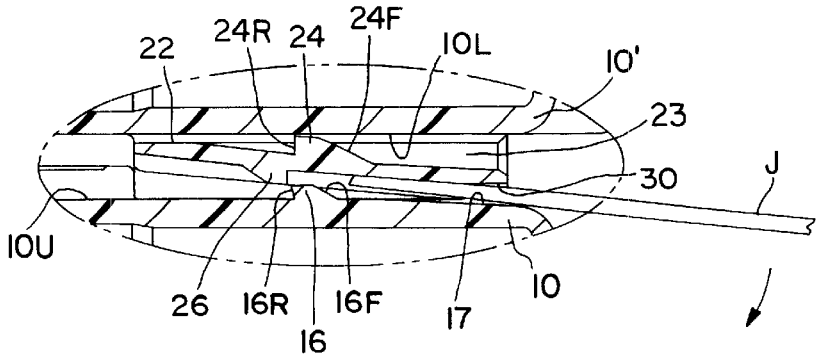
FIG. 4 is a partial section showing an intermediate state while the connector housings are being unlocked.

The connector housings 10, 10' can be disengaged from each other by inserting a narrow jig J in the form of a flat screwdriver into an insertion opening 30 defined between the connector housings 10, 10', as shown in FIG. 3. More particularly, the jig J is inserted through the insertion opening 30 and into the escape recess 17 between the elastic locking piece 22 and the upper surface 10U of the lower connector housing 10. The leading end of the jig J then is inclined upward with respect to the inserting direction and toward the elastic locking piece 22. The point of inclination at this time is the front end of the escape recess 17. The inclination causes the leading end of the jig J to push the elastic locking piece 22 in a position slightly before the first locking portion 16 and elastically displaces the elastic locking piece 22 upward. As a result, the first and second locking portions 16 and 26 are disengaged from each other. The connector housings 10, 10' are disengaged by sliding the upper connector housing 10 forward as shown in FIG. 5 while keeping the first and second locking portions 16, 26 disengaged.

The connector housing 10 is mounted on the stay S by bringing the lower surface 10L of the connector housing 10 closer to the horizontally projecting portion of the stay S so that the stay S is fit into the insertion space 23. This fitting operation causes the leading end of the stay S to contact the guide surface 24F of the stay locking portion 24. The inclined orientation of the guide surface 24F causes the elastic locking piece 22 to displace elastically downward and away from the lower surface 10L of the connector housing 10. When the connector housing 10 reaches its proper mount position on the stay S, the contact portions Sa of the stay S contact the front end surfaces of the opposite ends of the plate 20 to restrict any further insertion of the stay S into the insertion space 23. The elastic locking piece 22 then is restored elastically substantially to its original position so that the locking surface 24R of the stay locking portion 24 engages the rear edge of the locking hole Sc from front. As a result, the connector housing 10 is prevented from being disengaged backward from the stay S. In this way, the connector housing 10 is locked to the stay S while making it impossible to withdraw or further insert the stay S from or into the connector housing 10.

The connector housing 10 can be detached from the stay S by placing a finger or jig on the free rear end of the elastic locking piece 22 to displace the elastic locking piece 22 elastically downward and away from the lower surface 10L of the connector housing 10. Then, as shown in FIG. 6, the stay locking portion 24 is disengaged from the locking hole Sc of the stay S. The connector housing 10 can be moved backward while keeping the stay locking portion 24 and the locking hole Sc disengaged to disengage the connector housing 10 from the stay S.

As described above, the upper surface 10U of the connector housing 10 is formed with the first locking projection 16 as the connecting means for the connector housings 10. Additionally, the lower surface 10L of the connector housing 10 has the elastic locking piece 22 provided with the second locking portion 26 as the connecting means for the connector housings 10, 10' and the stay locking portion 24 as the mounting means for mounting the connector housing 10 on the stay S. Thus, plural connector housings 10 can be mounted on one stay S while being connected with each other. Preferably, the two mating connector housings 10, 10' have identical or similar shape and/or configuration.

The inserting direction of the stay S into the insertion space 23 is the same as the extending direction of the elastic locking piece 22 from its point of pivotal movement toward the extending end. Thus, the base end of the stay S extends out of the insertion space 23 in a direction opposite from the extending end of the elastic locking piece 22 with the stay S inserted in the insertion space 23. Accordingly, a finger or the jig J can be placed on the extending end of the elastic locking piece 22 without interfering with the stay S to disengage the stay locking portion 24 of the elastic locking piece 22 from the stay S.

The insertion opening 30 of the connector housing 10 for the jig J is at the side substantially opposite the wire draw-out surface 14 of the connector housing 10, and the jig J is inserted from the side substantially opposite from the side where the wires 13 are drawn out. Thus, the wires 13 do not interfere with the insertion of the jig J.

The jig J is inclined to deflect the elastic locking piece 22. The inserting direction of the stay S into the connector housing 10 is substantially the same as the extending direction of the elastic locking piece 22 from its point of pivotal movement toward the extending end. Additionally, points of inclination of the jig J and the elastic locking piece 22 are substantially at the same longitudinal position. Therefore, the jig J can be held substantially along the elastic locking piece 22.

The escape recess 17 in the upper surface 10U of the connector housing 10 enables a narrow clearance between the upper surface 10U of the lower connector housing 10 where the first locking portion 16 is formed and the lower surface of the elastic locking piece 22 of the upper connector housing 10' when the upper and lower connector housings 10 are connected.

The present invention is not limited to the above described and illustrated embodiment. For example, the following embodiments are also embraced by the technical scope of the .present invention as defined in the claims. Beside the following embodiments, various changes can be made without departing the sprit of the present invention as defined in the claims.

Although the illustrated embodiment is applied to a joint connector for a wiring harness, it is also applicable to wire-to-wire connectors at intermediate positions of wiring harnesses.

The extension of the elastic locking piece 22 on the connector housing 10 of the foregoing embodiment is substantially the same as the fitting direction of the connector housing 10 with the mating connector housing 10'. However, the two directions may be opposite from each other.

The extension of the elastic locking piece 22 is substantially the same as the inserting direction of the stay S into the insertion space 23 in the foregoing embodiment. However, the two directions may be opposite from each other.

The extension of the elastic locking piece 22 is substantially the same as the inserting direction of the jig J into the connector housing 10, 10' in the foregoing embodiment. However, the two directions may be opposite.

The inserting direction of the stay S into the insertion space 23 is substantially the same as the inserting direction of the jig J into the connector housing 10, 10' in the foregoing embodiment. However, the two directions may be opposite from each other according to the present invention.

Although the drawing direction of the wires from the connector housing is the same as the extension of the elastic locking piece in the foregoing embodiment, the two directions may be opposite from each other.

Although the drawing direction of the wires 13 from the connector housing 10 is the same as the inserting direction of the stay S into the insertion space 23 in the foregoing embodiment, the two directions may be opposite.

Although the drawing direction of the wires 13 from the connector housing 10, 10' is substantially the same as the inserting direction of the jig J into the connector housing 10, 10' in the foregoing embodiment, the two directions may be opposite from each other according to the present invention.

Although both first and second locking portions 16, 26 are projections in the foregoing embodiment, either one of them may be formed into a projection while the other may be formed into a hole according to the present invention.

The stay locking portion 24 is a projection and the locking portion Sc of the stay S is a hole in the foregoing embodiment. However, the stay locking portion 24 may be a hole and the locking portion Sc of the stay S may be a projection according to the present invention.

The first and second locking portions 16, 26 are on the outer surfaces of the connector housing 10, 10' opposite to each other in the foregoing embodiment. However, the outer surface where the first locking portion 16 is formed and the one where the second locking portion 26 is formed may be arranged at an angle to each other.

What is claimed is:

1. A plurality of connector housings (10, 10') connectable with one another and being mountable on a stay (S) projecting from a mounting member (A), wherein the connector housings (10, 10') each comprise:

at least one first coupling portion (18) in proximity to a first outer surface of each said connector housing (10, 10'), at least one second coupling portion (28) in proximity to a second outer surface of each said connector housing (10, 10') and configured such that the second coupling portion (28) of a first of said connector housings (10, 10') is connectable with the first coupling portion (18) of a second of the connector housings (10, 10') for connecting the connector housings (10, 10'), at least one first locking portion (16) on the first outer surface of each said connector housing (10, 10'), and an elastic locking piece (22) spaced from the second outer surface of each said connector housing (10, 10') such that an insertion space (23) is defined between the elastic locking piece (22) and the second outer surface, the insertion space (23) being dimensioned for receiving the stay (S), the elastic locking piece (22) being elastically deformable toward and away from the respective second outer surface, a stay locking portion (24) formed on the elastic locking piece (22) and projecting into the insertion space (23) for engaging the stay (S) inserted into the insertion space (23), and a second locking portion (26) formed on a side of the elastic locking piece (22) facing away from the insertion space (23) for engaging the first locking portion (16) of another of the connector housings (10, 10') and preventing the connector housings (10, 10') from being disengaged.

2. The connector housings of claim 1, wherein an inserting direction of the stay (S) into the insertion space (23) is substantially the same as an extending direction of the elastic locking piece (22).

3. The connector housings of claim 1, wherein the elastic locking piece (22) is deflectable in a direction to bring the second locking portion (26) away from the first locking portion (16).

4. The connector housings of claim 3, wherein a jig insertion opening (30) is provided at a side of the connector housing (10) opposite from a wire draw-out surface (14) of the connector housing (10) for receiving a jig (J).

5. The connector housings of claim 4, wherein an inserting direction of the jig (J) into the connector housing (10) is substantially the same as an extending direction of the elastic locking piece (22).

6. The connector housings of claim 5, wherein an escape recess (17) for permitting an inclining movement of the jig (J) to incline the elastic locking piece (22) is formed in the first outer surface of the connector housing (10).

7. The connector housings of claim 6, wherein the escape recess (17) is inclined with respect to an insertion direction of the jig (J) into the insertion opening (30) of the connector housing (10).

8. The connector housings of claim 1, wherein the first coupling portion (18) comprises at least one first stopper (19) for abutting a corresponding second coupling portion (28) of another of the connector housings (10').

9. The connector housings of claim 8, wherein the second coupling portion (28) comprises at least one second stopper (29) for abutting a corresponding first coupling portion (16) of the other connector housing (10'), wherein first and second stoppers (19, 29) abut the corresponding second and first coupling portion (28, 18), respectively.

10. A connector housing (10) for mounting on a stay (S) projecting from a mounting member (A), said connector housing (10) having opposed front and rear ends defining a longitudinal direction for said connector housing (10), a plurality of outer surfaces extending between said front and rear ends, said connector housing (10) comprising:

at least one first coupling rib (18) extending from a first of said outer surfaces (100) and aligned substantially along said longitudinal direction;

a first locking projection (16) on said first outer surface (10U) at a location spaced from said coupling rib (18);

at least one second coupling rib (28) projecting from a second of said outer surfaces (10L) and configured for slidable engagement with the first coupling rib (18) on another connector housing (10'); and an elastic locking piece (22) cantilevered from the second outer surface (10L) and extending substantially parallel to said longitudinal direction such that an insertion space (23) is defined between the elastic locking piece (22) and the second outer surface (10L), the insertion space (23) being dimensioned for slidably receiving the stay (S), a stay locking portion (24) formed on the elastic locking piece (22) and projecting into the insertion space (23) for engaging the stay (S) inserted into the insertion space (23), and a second locking portion (26) formed on a side of the elastic locking piece (22) facing away from the insertion space (23) for engaging the first locking portion (16) of the other connector housing (10'), whereby the connector housing (10) can be engaged with the stay (S) and can be engaged with at least the other connector housing (10').

11. The connector housing (10) of claim 10, wherein the at least one first coupling rib (18) comprises a pair of parallel first coupling ribs (18) disposed respectively on opposite sides of the first locking portion (16).

12. The connector housing (10) of claim 11, wherein the at least one second coupling rib (28) comprises a pair of second coupling ribs (28) disposed respectively for engaging the pair of first coupling ribs (18), the second coupling ribs (28) being disposed on opposite respective sides of the elastic locking piece (22).

* * * * *